US007066745B1

(12) United States Patent
Chen

(10) Patent No.: US 7,066,745 B1
(45) Date of Patent: Jun. 27, 2006

(54) POWER SUPPLY CONNECTOR

(76) Inventor: Chi-Wen Chen, No. 105, Alley 27, Lane 143, Chun-Kung Rd., Taipei City (TW)

( * ) Notice: Subject to any disclaimer, the term of this patent is extended or adjusted under 35 U.S.C. 154(b) by 0 days.

(21) Appl. No.: 11/251,709

(22) Filed: Oct. 17, 2005

(51) Int. Cl.
*H01R 13/44* (2006.01)
*H01R 13/60* (2006.01)

(52) U.S. Cl. ..... 439/131; 439/172

(58) Field of Classification Search ..... 439/131, 439/172, 173
See application file for complete search history.

(56) References Cited

U.S. PATENT DOCUMENTS 2,538,296 A * 1/1951 Crocker ..... 439/172
3,458,794 A * 7/1969 Bohnstedt et al. ..... 320/111
4,626,052 A * 12/1986 Rumble ..... 439/173
4,697,070 A * 9/1987 Kai ..... 219/521
5,006,779 A * 4/1991 Fenne et al. ..... 320/111
5,023,396 A * 6/1991 Bartee et al. ..... 174/48
5,082,450 A * 1/1992 Warren et al. ..... 439/102
5,135,406 A * 8/1992 Ishikawa ..... 439/131
5,401,178 A * 3/1995 Liu ..... 439/131
5,628,641 A * 5/1997 Hahn ..... 439/131
5,634,806 A * 6/1997 Hahn ..... 439/173
5,692,921 A * 12/1997 Jennings ..... 439/346
5,829,993 A * 11/1998 Wu ..... 439/131
5,973,948 A * 10/1999 Hahn et al. ..... 363/146
6,042,400 A * 3/2000 Queffelec et al. ..... 439/131
6,227,888 B1 * 5/2001 Hahn ..... 439/173
6,270,364 B1 * 8/2001 Wang ..... 439/131
6,275,002 B1 * 8/2001 Chen ..... 320/111
6,632,098 B1 * 10/2003 Wong et al. ..... 439/131
6,722,900 B1 * 4/2004 Segawa et al. ..... 439/131
6,835,903 B1 * 12/2004 Liu et al. ..... 200/43.02
2003/0045143 A1 * 3/2003 Chen ..... 439/131

* cited by examiner

*Primary Examiner*—Tulsidas C. Patel
*Assistant Examiner*—Vladimir Imas
(74) *Attorney, Agent, or Firm*—Haynes Beffel & Wolfeld LLP

(57) ABSTRACT

A power supply connector includes a housing and a prong unit. The housing has opposite first and second housing walls, a peripheral wall extending between the first and second housing walls to define an accommodation space, a prong slot having a first slot section formed in the peripheral wall and a second slot section formed in the first housing wall, and a pair of slide rails disposed on opposite sides of the prong slot. The prong unit includes a prong base disposed in the accommodation space, and two conductive prongs mounted on the prong base. The prong base is slidable along the slide rails so that the prongs extend out of the housing through the first slot section or the second slot section of the prong slot.

10 Claims, 6 Drawing Sheets

POWER SUPPLY CONNECTOR

BACKGROUND OF THE INVENTION

1. Field of the Invention

The invention relates to a power supply connector, more particularly to a power supply connector having a prong unit that can be varied in position relative to a connector housing.

2. Description of the Related Art

Electrical appliances and tools are provided with a power supply connector for connection to a power source. Conventional power supply connectors include conductive prongs that project out of a connector housing for plugging into corresponding holes in a power socket. While power supply connectors, which have a prong unit that is pivotable relative to a connector housing so that the projecting direction of the prong unit relative to the connector housing can be altered, are known in the art, the prong unit is fixed in position at an edge of the connector housing such that connection stability cannot be ensured, especially in applications where the power supply connector is relatively heavy due to the presence of voltage conversion components therein.

SUMMARY OF THE INVENTION

Therefore, the object of the present invention is to provide a power supply connector having a prong unit that can be varied in position relative to a connector housing so as to overcome the aforesaid drawback associated with the prior art.

Accordingly, a power supply connector of this invention comprises a housing, a prong unit, a power interface unit, and a conductive contact unit.

The housing has a first housing wall, a second housing wall opposite to the first housing wall, a peripheral wall extending between the first and second housing walls to configure the housing with an accommodation space, a prong slot including a first slot section that is formed in the peripheral wall, and a second slot section that extends from the first slot section and that is formed in the first housing wall, and a pair of slide rails disposed on opposite sides of the prong slot.

The prong unit includes a prong base disposed in the accommodation space, and a pair of conductive prongs mounted on the prong base. The prong base is slidable along the slide rails to dispose the prongs in a selected one of a first position, where the prongs extend out of the housing through the first slot section of the prong slot, and a second position, where the prongs extend out of the housing through the second slot section of the prong slot.

The power interface unit is mounted in the accommodation space.

The conductive contact unit is mounted in the accommodation space, and establishes electrical connection between the power interface unit and the prong unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
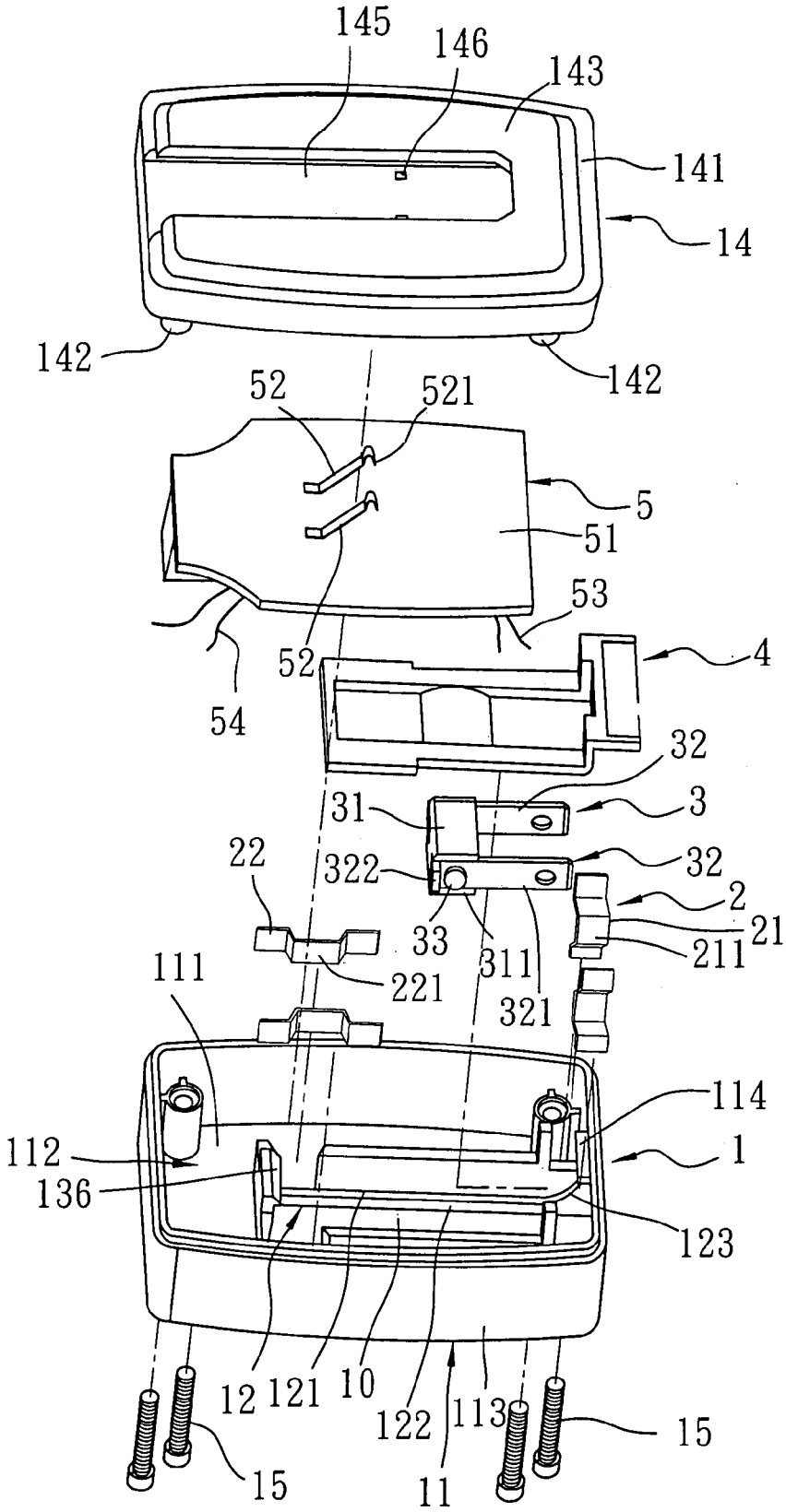
FIG. 1 is an exploded perspective view of the preferred embodiment of a power supply connector according to the present invention.
Figure 2:
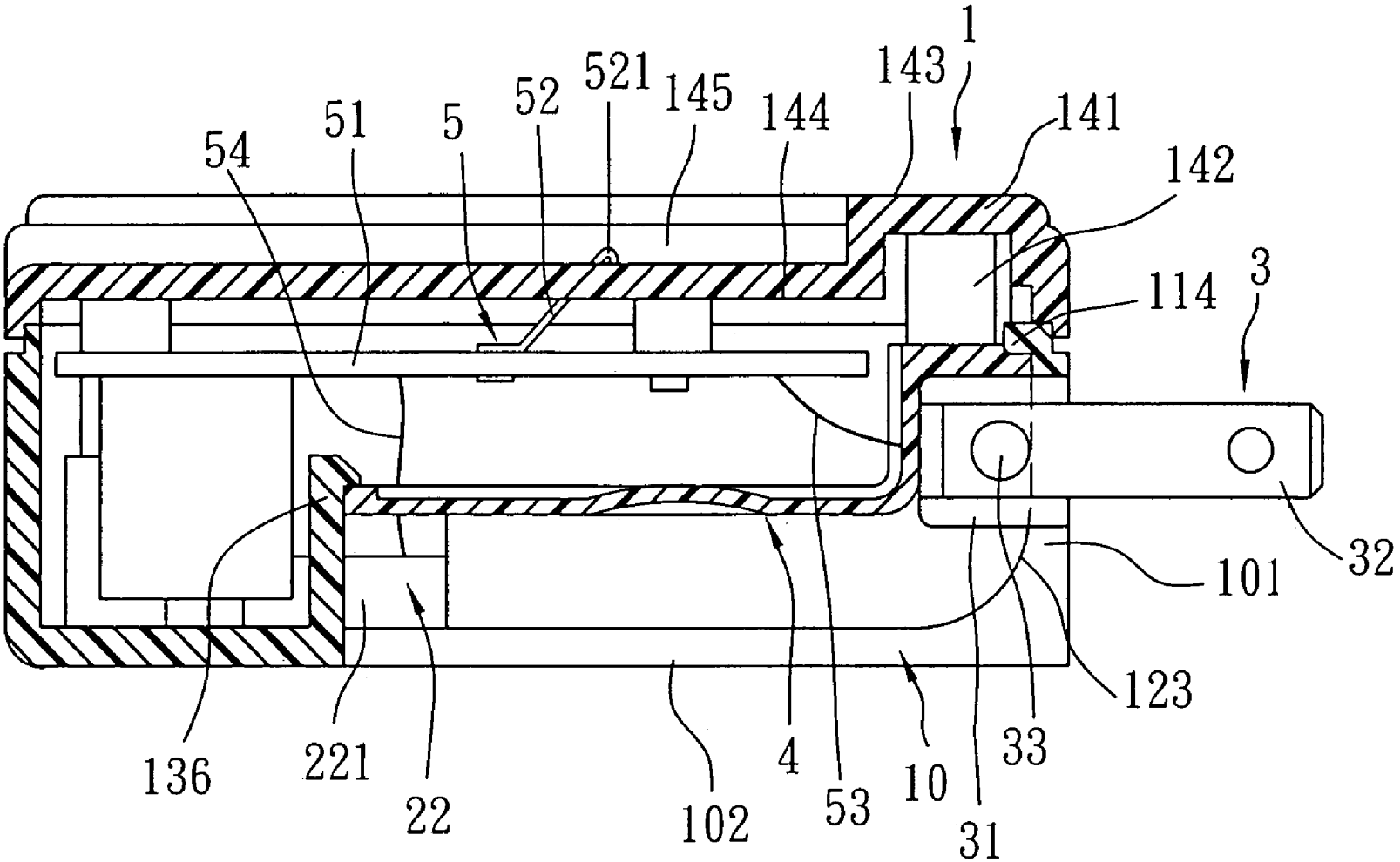
FIG. 2 is an assembled sectional view of the preferred embodiment, illustrating a state where conductive prongs of a prong unit are disposed at a first position.
Figure 3:
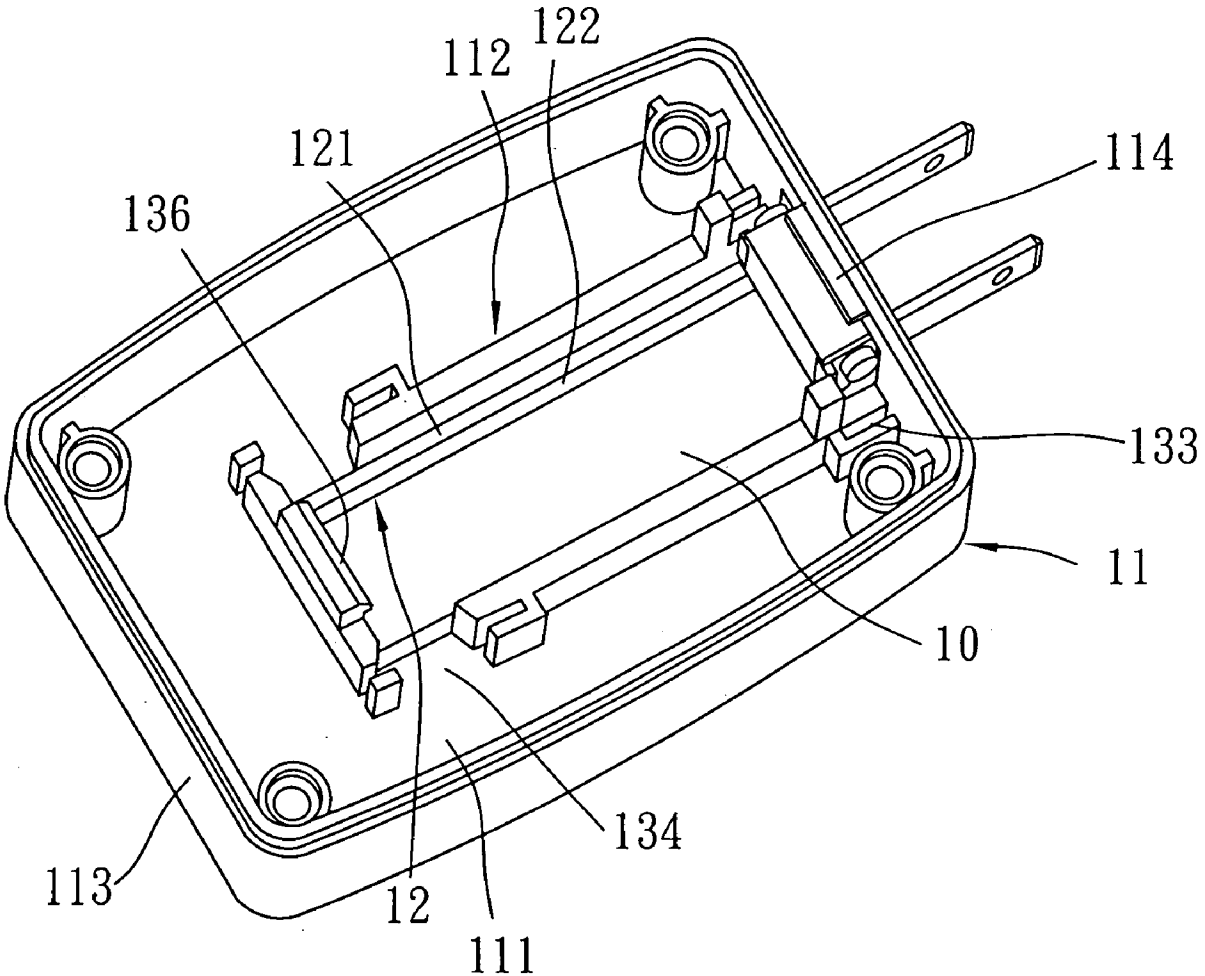
FIG. 3 is a fragmentary perspective view to illustrate the prong unit and a first housing part of the preferred embodiment.

Referring to FIGS. 1, 2 and 3, the preferred embodiment of a power supply connector according to the present invention has a voltage converting functionality, and is applicable for charging a mobile phone handset (not shown). The power supply connector comprises a housing 1, a prong unit 3, a power interface unit 5, and a conductive contact unit 2.

The housing 1 includes a lower housing part 11 and an upper housing part 14. The lower housing part 11 has a rectangular first housing wall 111. The upper housing part 14 has a second housing wall 141 opposite to the first housing wall 111. The lower housing part 11 further has a peripheral wall 113 that extends from a periphery of the first housing wall 111 toward the second housing wall 141 to configure the housing 1 with an accommodation space 112. Screw posts 142 extend from the second housing wall 141 into the accommodation space 112. Screws 15 extend through the first housing wall 111 and engage the screw posts 142 to secure the upper housing part 14 to the lower housing part 11.

A prong slot 10 is formed in the lower housing part 11. The prong slot 10 includes a first slot section 101 that is formed in the peripheral wall 113, and a second slot section 102 that extends from the first slot section 101 and that is formed in the first housing wall 111. The first and second slot sections 101, 102 form a 90-degree angle therebetween. The lower housing part 11 further has a pair of slide rails 12 disposed on opposite sides of the prong slot 10 and projecting into the accommodation space 112.

Figure 4:
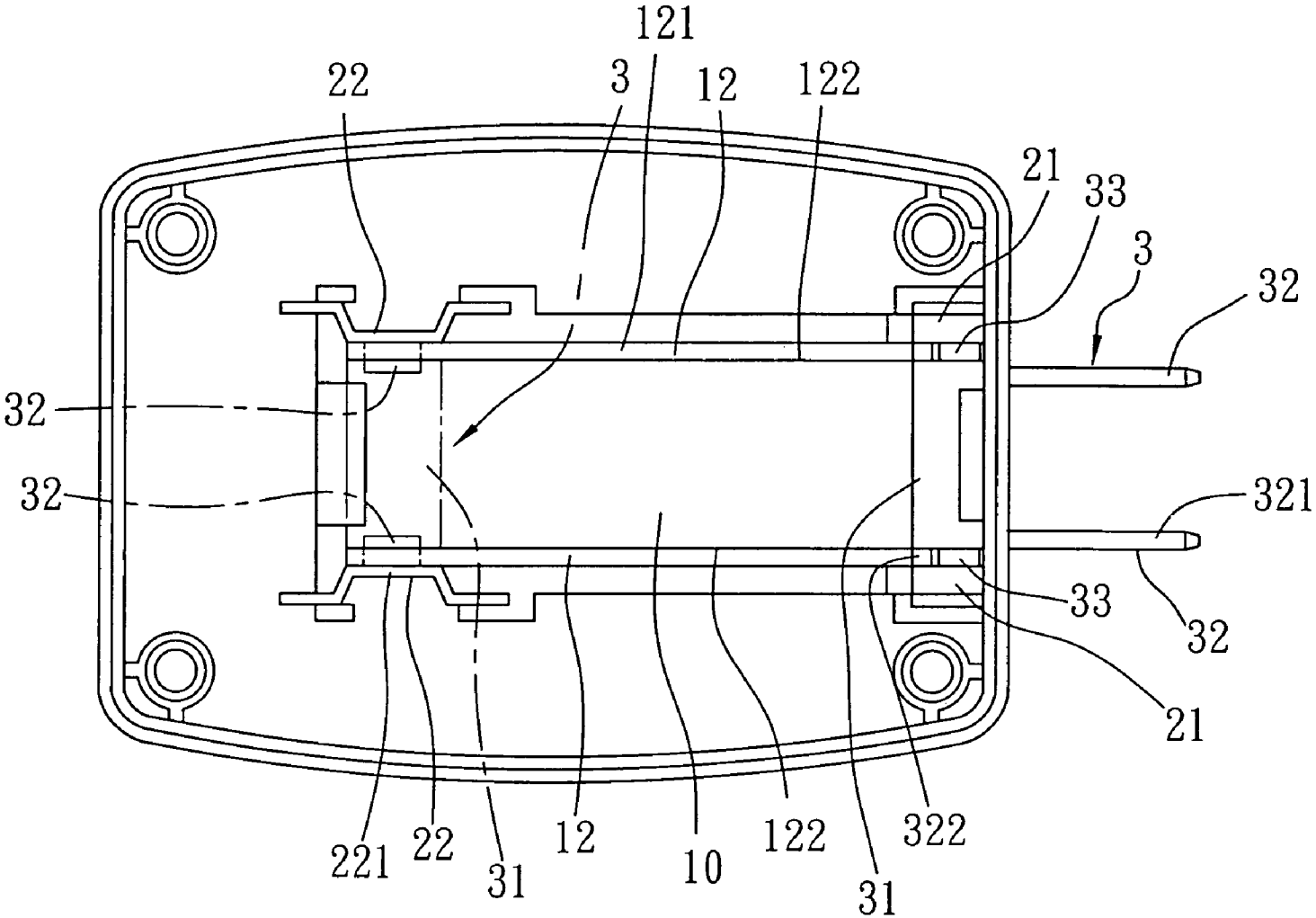
FIG. 4 is a schematic view of FIG. 3.

The prong unit 3 includes a rectangular prong base 31 disposed in the accommodation space 112, and a pair of conductive prongs 32 mounted in parallel on the prong base 31. With further reference to FIG. 4, the prong base 31 is slidable along the slide rails 12 to dispose the prongs 32 in a selected one of a first position (see FIG. 2), where the prongs 32 extend out of the housing 1 through the first slot section 101 of the prong slot 10, and a second position (see FIGS. 5 and 6), where the prongs 32 extend out of the housing 1 through the second slot section 102 of the prong slot 10.

In this embodiment, each of the prongs 32 has a plugging section 321 for plugging into a corresponding hole in a power socket (not shown), and a conducting section 322 proximate to the prong base 31. The slide rails 12 have confronting surfaces 122 in sliding contact with the plugging sections 321 of the prongs 32, respectively. In addition, each of the slide rails 12 further has a guide surface 121 that is transverse to the respective surface 122 and that faces toward the second housing wall 141 of the upper housing part 14. The prong base 31 has opposite lateral sides 311, each of which is provided with a guide projection 33 that is slidably disposed on the guide surface 121 of a respective one of the slide rails 12. In this embodiment, the guide surface 121 of each of the slide rails 12 has a curved section 123 adjacent to the peripheral wall 113 such that the prong base 31 is pivotable relative to the housing 1 at the curved sections 123 of the guide surfaces 121 of the slide rails 12.

Preferably, to ensure the sliding route of the prong unit 3, the power supply connector further comprises a press frame 4 mounted in the accommodation space 112 for pressing the prong base 31 of the prong unit 3 toward the slide rails 12. In this embodiment, to mount the press frame 4 in the housing 1, the housing 1 further has a flange 114 that extends from the peripheral wall 113 into the accommodation space 112 and that is disposed above the prong slot 10, and a hook member 136 that extends from the first housing wall 111 into the accommodation space 112 and that is disposed at one end of the second slot section 102 remote from the first slot section 101. The flange 114 and the hook member 136 engage opposite ends of the press frame 4 such that the prong base 31 of the prong unit 3 is clamped between the press frame 4 and the slide rails 12.

The power interface unit 5 is mounted in the accommodation space 112. The conductive contact unit 2 is also mounted in the accommodation space 112, and establishes electrical connection between the power interface unit 5 and the prong unit 3. In this embodiment, the power interface unit 5 includes a voltage conversion module 51 (some electric components thereof are omitted from the drawings for the sake of clarity), an external contact set that includes a pair of contact terminals 52 connected electrically to the voltage conversion module 51, and an internal wiring set that includes two sets of wires 53, 54 for interconnecting electrically the voltage conversion module 51 and the conductive contact unit 2.

In this embodiment, the second housing wall 141 of the upper housing part 14 has a top side 143, a bottom side 144, a power coupling area 145 indented from the top side 143, and a pair of contact holes 146 formed through the top and bottom sides 143, 144 and disposed at the power coupling area 145. Each of the contact terminals 52 of the external contact set has a terminal end 521 extending through a respective one of the contact holes 146 such that the external contact set is accessible from the power coupling area 145.

In practice, the external contact set of the power interface unit 5 may be in the form of a socket that is adapted for connection to an electrical appliance (not shown).

In this embodiment, the conductive contact unit 2 includes a first contact set 21 for establishing electrical contact with the prong unit 3 when the prongs 32 are disposed in the first position, and a second contact set 22 for establishing electrical contact with the prong unit 3 when the prongs 32 are disposed in the second position. Each of the first and second contact sets 21, 22 includes a pair of contact plates, each having a prong contact portion 211, 221 that extends toward the prong slot 10. The conducting sections 322 of the prongs 32 contact the prong contact portions 211 of the first contact set 21 when the prongs 32 are disposed in the first position, and contact the prong contact portions 221 of the second contact set 22 when the prongs 32 are disposed in the second position. The first and second contact sets 21, 22 are connected electrically to the wires 53, 54 of the power interface unit 5, respectively.

The housing 1 further has a fixing unit for fixing the first and second contact sets 21, 22 in the accommodation space 112. In this embodiment, the fixing unit includes a pair of first grooves 133 disposed adjacent to the first slot section 101 for retaining the contact plates of the first contact set 21 therein, and a pair of second grooves 134 disposed adjacent to the second slot section 102 and spaced apart from the first grooves 133 for retaining the contact plates of the second contact set 22 therein.

In other embodiments of this invention, the conductive contact unit 2 may include only one pair of contact plates, each formed with two prong contact portions that correspond respectively to the first and second positions of the prongs 32.

Referring to FIGS. 1, 2 and 4, when the prongs 32 of the prong unit 3 are disposed in the first position, the plugging sections 321 of the prongs 32 project from the peripheral wall 113, and the conducting sections 322 of the prongs 32 contact the prong contact portions 211 of the first contact set 21 of the conductive contact unit 2 to establish electrical connection with the voltage conversion module 51 of the power interface unit 5 via the wires 53 of the internal wiring set. Therefore, when an electronic device, such as a mobile phone handset (not shown), is coupled to the power coupling area 145 of the upper housing part 14, electrical connection between the electronic device and the voltage conversion module 51 of the power interface unit 5 is possible via the terminal ends 521 of the contact terminals 52 of the external contact set.

Figure 5:
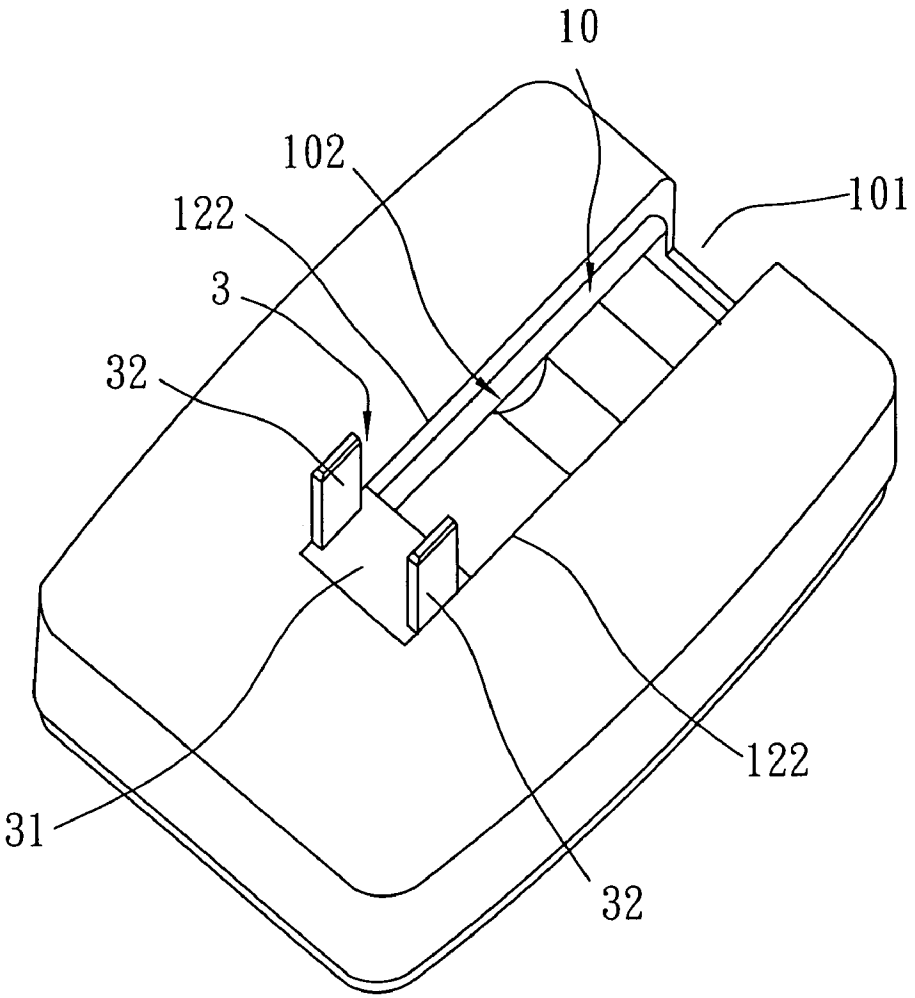
FIG. 5 is a perspective view to illustrate the conductive prongs of the prong unit when disposed at a second position.
Figure 6:
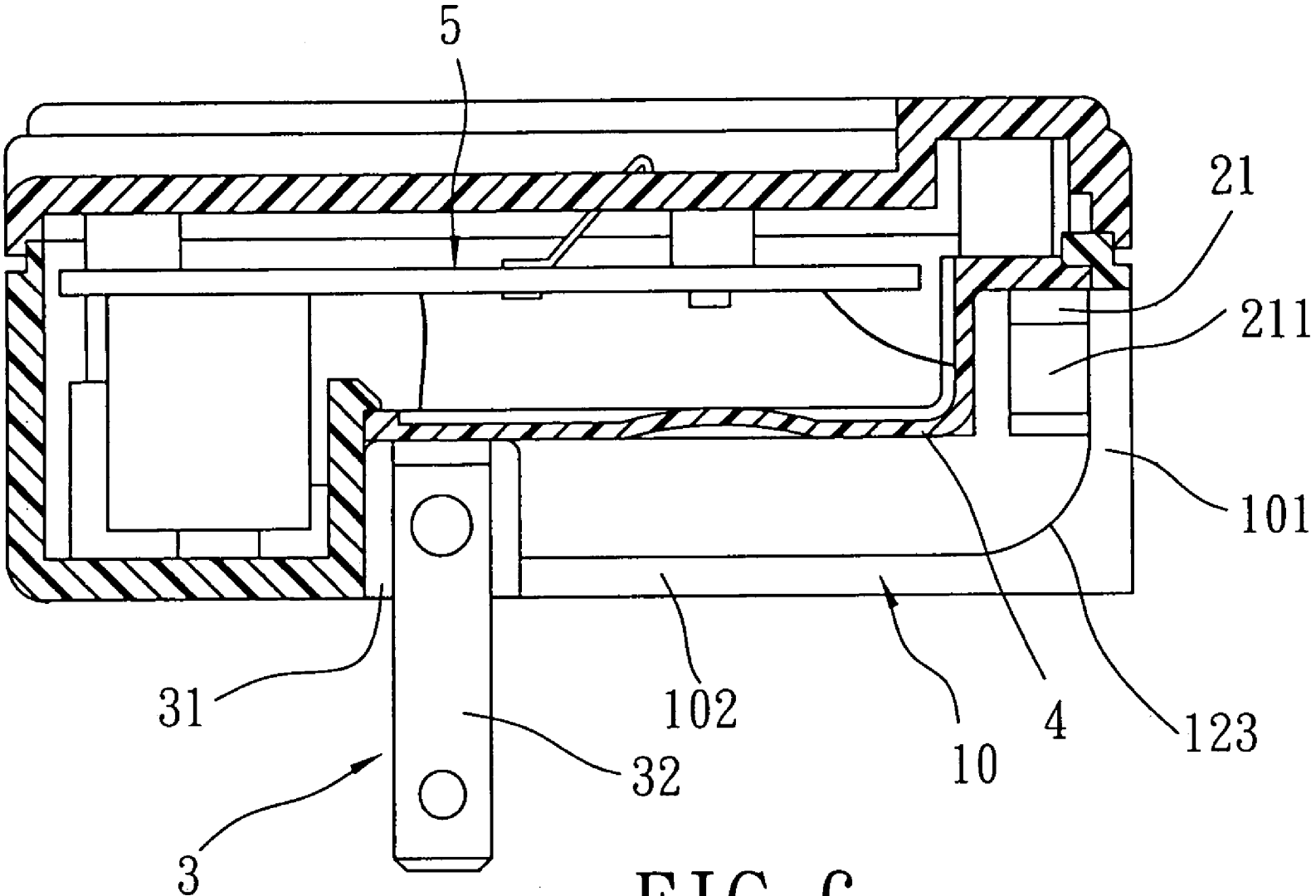
FIG. 6 is a view similar to FIG. 2, but illustrating a state where the conductive prongs of the prong unit are disposed at the second position.

Referring to FIGS. 4, 5 and 6, to dispose the prongs 32 of the prong unit 3 from the first position to the second position, the prong unit 3 is forced downwardly to enable sliding movement of the prong base 31 along the slide rails 12. As the prong base 31 travels along the curved sections 123 of the guide surfaces 121 of the slide rails 12, the orientation of the prongs 32 changes from horizontal to vertical. When the prong base 31 reaches the end of the second slot section 102 of the prong slot 10, the prong unit 3 is disposed in the second position, where the plugging sections 321 of the prongs 32 project from the first housing wall 111, and the conducting sections 322 of the prongs 32 contact the prong contact portions 221 of the second contact set 22 of the conductive contact unit 2 to establish electrical connection with the voltage conversion module 51 of the power interface unit 5 via the wires 54 of the internal wiring set.

It has thus been shown that the power supply connector of this invention permits varying of the position of the prong unit 3 relative to the housing 1 to improve connection stability during use.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A power supply connector comprising:

a housing having a first housing wall, a second housing wall opposite to said first housing wall, a peripheral wall extending between said first and second housing walls to configure said housing with an accommodation space, a prong slot including a first slot section that is formed in said peripheral wall, and a second slot section that extends from said first slot section and that is formed in said first housing wall, and a pair of slide rails disposed on opposite sides of said prong slot;

a prong unit including a prong base disposed in said accommodation space, and a pair of conductive prongs mounted on said prong base, said prong base being slidable along said slide rails to dispose said prongs in a selected one of a first position, where said prongs extend out of said housing through said first slot section of said prong slot, and a second position, where said prongs extend out of said housing through said second slot section of said prong slot;

a power interface unit mounted in said accommodation space; and a conductive contact unit mounted in said accommodation space for establishing electrical connection between said power interface unit and said prong unit.

2. The power supply connector as claimed in claim 1, wherein said slide rails have confronting surfaces in sliding contact with said prongs, respectively.

3. The power supply connector as claimed in claim 1, wherein each of said slide rails has a guide surface facing toward said second housing wall, and said prong base has opposite lateral sides, each of which is provided with a guide projection that is slidably disposed on said guide surface of a respective one of said slide rails.

4. The power supply connector as claimed in claim 3, wherein said guide surface of each of said slide rails has a curved section adjacent to said peripheral wall, said prong base being pivotable relative to said housing at said curved sections of said guide surfaces of said slide rails.

5. The power supply connector as claimed in claim 1, wherein said conductive contact unit includes a first contact set for establishing electrical contact with said prong unit when said prongs are disposed in the first position, and a second contact set for establishing electrical contact with said prong unit when said prongs are disposed in the second position.

6. The power supply connector as claimed in claim 5, wherein said housing further has a fixing unit for fixing said first and second contact sets in said accommodation space.

7. The power supply connector as claimed in claim 6, wherein each of said first and second contact sets includes a pair of contact plates, said fixing unit including a pair of first grooves disposed adjacent to said first slot section for retaining said contact plates of said first contact set therein, and a pair of second grooves disposed adjacent to said second slot section and spaced apart from said first grooves for retaining said contact plates of said second contact set therein.

8. The power supply connector as claimed in claim 1, further comprising a press frame mounted in said accommodation space for pressing said prong base of said prong unit toward said slide rails.

9. The power supply connector as claimed in claim 1, wherein said power interface module includes a voltage conversion module, an external contact set connected electrically to said voltage conversion module, and an internal wiring set interconnecting electrically said voltage conversion module and said conductive contact unit.

10. The power supply connector as claimed in claim 9, wherein said second housing wall has one side opposite to said accommodation space and formed with a power coupling area from which said external contact set is accessible.

* * * * *